US010870139B2

(12) United States Patent
Kuegel et al.

(10) Patent No.: US 10,870,139 B2
(45) Date of Patent: Dec. 22, 2020

(54) ADJUSTING A TARGETED TEMPERATURE PROFILE AT THE STRIP HEAD AND STRIP BASE PRIOR TO CROSS-CUTTING A METAL STRIP

(71) Applicant: Primetals Technologies Austria GmbH, Linz (AT)

(72) Inventors: Manfred Kuegel, Linz (AT); Axel Rimnac, Linz (AT); Alois Seilinger, Linz (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 570 days.

(21) Appl. No.: 15/328,324

(22) PCT Filed: Jul. 9, 2015

(86) PCT No.: PCT/EP2015/065731
§ 371 (c)(1),
(2) Date: Jan. 23, 2017

(87) PCT Pub. No.: WO2016/020134
PCT Pub. Date: Feb. 11, 2016

(65) Prior Publication Data

US 2017/0209907 A1 Jul. 27, 2017

(30) Foreign Application Priority Data

Aug. 6, 2014 (EP) ..... 14179980

(51) Int. Cl.
*B21B 37/74* (2006.01)
*B21B 1/26* (2006.01)
(Continued)

(52) U.S. Cl.
CPC ..... *B21B 37/74* (2013.01); *B21B 1/26* (2013.01); *B21B 45/0218* (2013.01); *B21B 2015/0014* (2013.01); *B21B 2261/21* (2013.01)

(58) Field of Classification Search
CPC ..... B21B 15/007; B21B 2015/0014; B21B 37/74; B21B 37/76; B21B 45/0233; B21B 1/26; B21B 2261/21; B21B 45/0218
(Continued)

(56) References Cited

U.S. PATENT DOCUMENTS 5,560,236 A * 10/1996 Onda ..... B21B 1/26 228/158
5,727,412 A * 3/1998 Tippins ..... C21D 8/0226 72/201
(Continued)

FOREIGN PATENT DOCUMENTS

CN 101378856 A 3/2009
CN 101755058 A 6/2010
(Continued)

OTHER PUBLICATIONS

Machine translation of JP-62234611-A, Tagashira, pp. 1-3, translated on Apr. 30, 2019. (Year: 2019).*
(Continued)

*Primary Examiner* — Adam J Eiseman
*Assistant Examiner* — Mohammed S. Alawadi
(74) *Attorney, Agent, or Firm* — Ostrolenk Faber LLP

(57) ABSTRACT

A rolling mill with a cooling zone for cooling and scissors for cross-cutting metal strips, which are preferably made of steel. A method and a device enables metal strips with thicknesses >4 mm and/or metal strips made of high-strength materials to be cross-cut by the scissors arranged after a production line and a cooling zone. In the method, the metal strip (6) is cooled in the cooling zone (10) to a
(Continued)

specified temperature profile in the longitudinal direction of the metal strip (6) such that the metal strip (6) has a higher temperature in the region of the strip head of the trailing metal strip portion (31) and the strip base of the leading metal strip portion (32) than in the upstream and downstream regions.

21 Claims, 7 Drawing Sheets

(51) Int. Cl.
*B21B 45/02* (2006.01)
*B21B 15/00* (2006.01)

(58) Field of Classification Search
USPC ..... 72/7.5, 8.8, 201, 203, 342.6
See application file for complete search history.

(56) References Cited

U.S. PATENT DOCUMENTS 6,536,254 B1 * 3/2003 Kawalla ..... B21B 37/24 72/200
8,282,747 B2 * 10/2012 Oda ..... B21B 37/76 148/644
8,359,119 B2 * 1/2013 Schmors ..... C21D 11/005 148/511
8,601,851 B2 12/2013 Seidel ..... 72/364
9,174,255 B2 11/2015 Diez et al.
9,889,480 B2 * 2/2018 Nelson ..... B21B 37/44
2002/0184984 A1 * 12/2002 Rosenthal ..... B23D 25/12 83/305
2004/0221929 A1 * 11/2004 Hebda ..... C22F 1/183 148/670
2010/0132426 A1 * 6/2010 Baumgartel ..... B21B 37/74 72/342.2
2010/0175452 A1 * 7/2010 Ohlert ..... C21D 8/0463 72/200
2010/0180655 A1 * 7/2010 Ishige ..... C21D 9/46 72/200
2012/0004757 A1 * 1/2012 Imanari ..... B21B 37/74 700/104
2012/0103052 A1 * 5/2012 Ueoka ..... B21B 45/0233 72/342.2
2012/0160377 A1 * 6/2012 Seidel ..... C21D 8/0226 148/654
2013/0145807 A1 * 6/2013 Benedetti ..... B21B 1/06 72/201
2014/0034264 A1 * 2/2014 Benedetti ..... B21B 13/22 164/476
2014/0096578 A1 * 4/2014 Eckerstorfer ..... F27B 19/04 72/40
2015/0023387 A1 * 1/2015 Narihara ..... B21B 38/006 374/45
2015/0196941 A1 * 7/2015 Lengauer ..... B21B 1/463 164/460
2015/0218668 A1 * 8/2015 Kwak ..... B21B 1/26 428/656
2015/0306645 A1 * 10/2015 Song ..... B21B 1/22 72/53
2015/0375286 A1 * 12/2015 Jirkova ..... C21D 7/13 72/342.6
2016/0067753 A1 * 3/2016 Klein ..... B21B 45/004 148/557
2016/0101450 A1 * 4/2016 Linzer ..... B21B 39/004 72/201
2016/0243611 A1 * 8/2016 Benedetti ..... B22D 11/103
2017/0209907 A1 7/2017 Kuegel et al.

FOREIGN PATENT DOCUMENTS

DE 694 10 562 10/1998
DE 10 2007 007 560 A1 8/2008
DE 10 2008 010 062 12/2008
EP 0 730 916 A1 9/1996
EP 1 925 373 A1 8/2008
EP 2 258 491 A1 12/2010
EP 3 177 412 6/2017
JP 62234611 A * 10/1987 ..... B21B 37/74
JP S62234611 A * 10/1987
JP 10-29004 2/1998
JP 2003-200203 7/2003
RU 2415725 C2 4/2011
WO WO 00/59650 A1 10/2000

OTHER PUBLICATIONS

English translate (JPS62234611A), retrieved date Nov. 22, 2019.*
Temperature and Strength of Metals, retrieved date Nov. 22, 2019.*
EngArc—L—Effect of Temperature on Tensile Properties, retrieved date Nov. 22, 2019.*
M. Spittel et al. "Numerical Data and Functional Relationships in Science and Technology" New Series / Editor in Chief: W. Martienssen, Flow stress of steel, pp. 1-33 (2009).
International Search Report dated Sep. 24, 2015 issued in corresponding International patent application No. PCT/EP2015/065731.
Written Opinion dated Sep. 24, 2015 issued in corresponding International patent application No. PCT/EP2015/065731.
European Search Report dated Dec. 19, 2014 issued in corresponding European patent application No. 14179980.9.
Russian Federation Decision to Grant, dated Dec. 12, 2018, issued in corresponding Russian Federation Patent Application No. 2017106342/04(011160). Total 12 pages.
Office Action dated Dec. 7, 2018 issued in corresponding Chinese Patent Application No. 201580042202.5 with English translation.
Indian First Examination Report issued in Indian Application No. 201717002528 dated May 23, 2019.
European Notice of Opposition issued in European Patent Application No. 15738039.5 dated Jun. 24, 2019.
Engel et al., "Hochfeste Stähle," IBU Vortragsreihe; Universität Siegen (Dec. 2008) and Statement of Relevance.

* cited by examiner

FIG. 4A
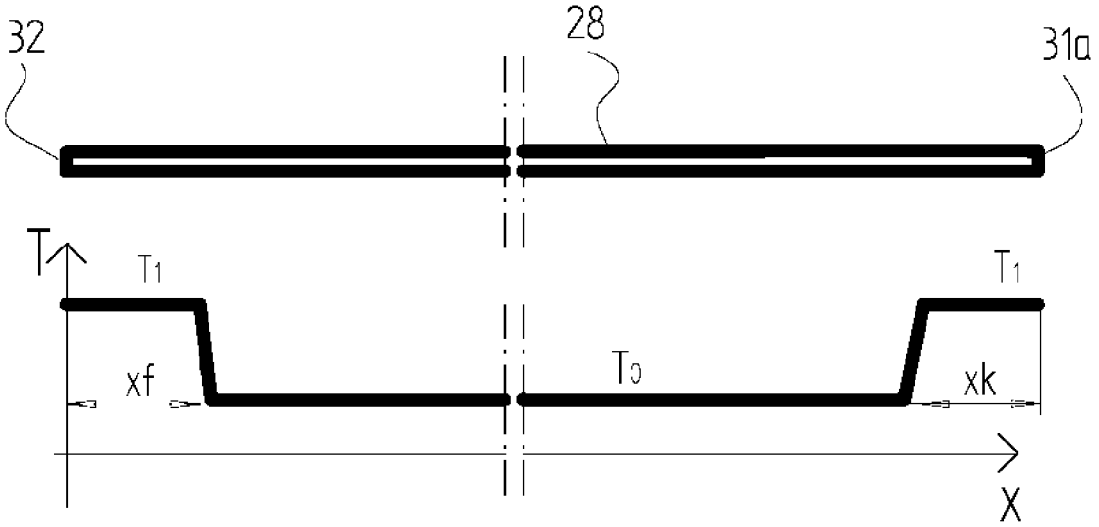
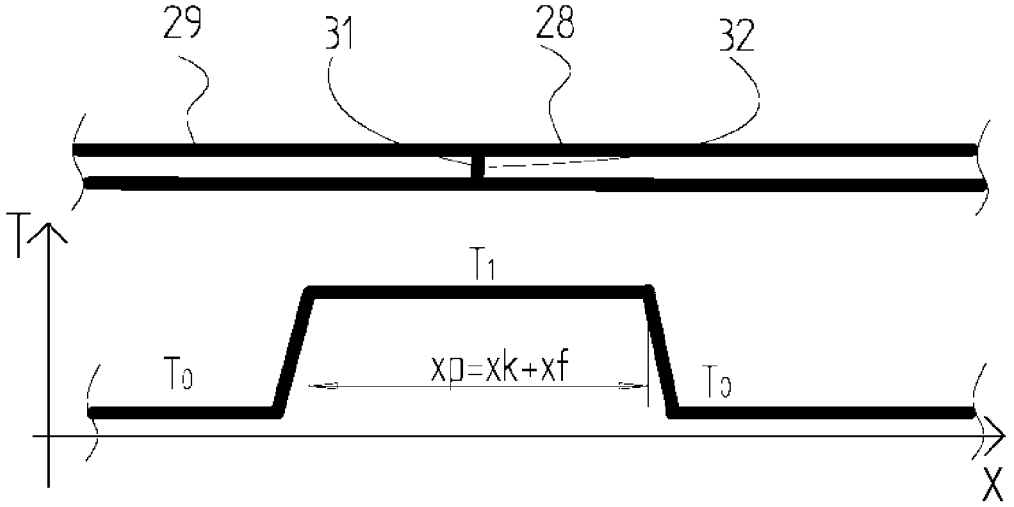
FIG. 4B

FIG. 7A
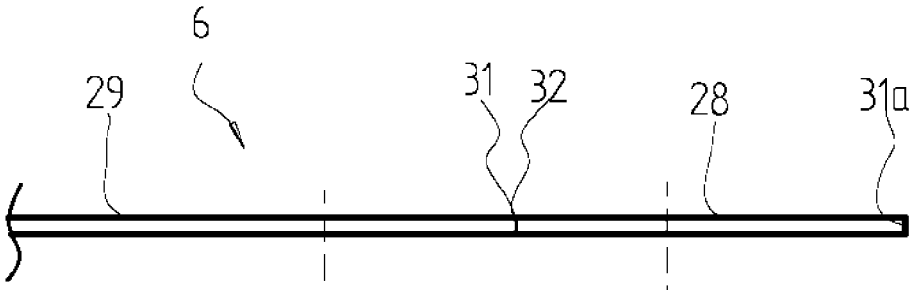
FIG. 7B
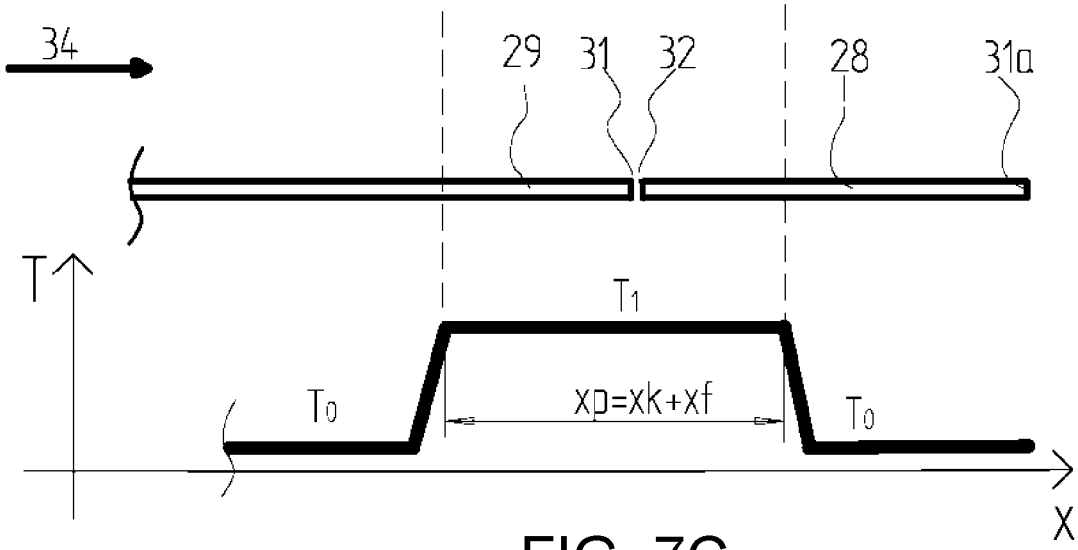
FIG. 7C

ADJUSTING A TARGETED TEMPERATURE PROFILE AT THE STRIP HEAD AND STRIP BASE PRIOR TO CROSS-CUTTING A METAL STRIP

CROSS-REFERENCE TO RELATED APPLICATIONS

The present application is a 35 U.S.C. §§ 371 national phase conversion of PCT/EP2015/065731, filed Jul. 9, 2015, which claims priority of European Patent Application No. 14179980.9, filed Aug. 6, 2014, the contents of which are incorporated by reference herein. The PCT International Application was published in the German language.

TECHNICAL FIELD

The present invention relates to the field of metallurgical plants, specifically a rolling mill with a cooling zone for cooling down metal strips, preferably strips of steel, and shears for cutting the strips.

TECHNICAL BACKGROUND

On the one hand, the invention relates to a method for cross-cutting a metal strip, preferably a steel strip, wherein the method comprises the following steps:

- feeding the metal strip in a direction of transport through a cooling zone;
- cooling down the metal strip in the cooling zone; then
- cross-cutting the metal strip on shears, so that the metal strip is cross-cut into a preceding or leading section of metal strip having a strip tail of the preceding section of metal strip and a following or trailing section of metal strip with a strip head of the following section of metal strip and, in the direction of transport of the strip, the strip head of the following section of metal strip follows on immediately after the strip tail of the preceding section of metal strip.

On the other hand, the invention relates to a facility for cross-cutting a metal strip for carrying out the inventive method. The facility includes a roller track for feeding the metal strip, with at least one cooling facility, wherein a cooling device is arranged before shears to be used for cross-cutting the metal strip, so that the metal strip is divided crosswise into a preceding or leading section of metal strip, having a strip tail of the preceding section of metal strip, and a following or trailing section of metal strip having a strip head of the following section of metal strip, and the strip head of the following section of metal strip follows on immediately in the direction of transport from and after the strip tail of the preceding section of metal strip.

PRIOR ART

In the following description, shears ahead of the finishing line, which may for example be in the form of pendulum shears, are referred to as a cutting facility. Shears, for example constructed in the form of drum shears, are arranged after the finishing line and before a coiler and are referred to as shears.

Cross-cutting of metal strips, especially of high-strength steel materials (with yield stresses above 500 MPa) and/or with thicknesses greater than 4 mm demands, under the prior art, some changes to the plant configuration. In order to be able to reliably cut high-strength and/or thick metal strips, the construction of some of the parts of the plant must be appropriately larger. Due to inertia and the high cutting speed, the shears before the coiler cannot be designed to be arbitrarily large. Because of these restrictions, the metal strip is often cut on a cutting facility which is located before the finishing line, and after this the metal strip is finish-rolled in batch mode. However, as a consequence of this, in order to ensure an adequate gap between the tail of a strip and the head of a strip the preceding section of any strip must be rapidly accelerated. An adequate gap is required in order that no collisions may occur between the strip head and the strip tail in subsequent parts of the plant e.g. before the coiler. Furthermore, it is necessary to ensure that it is impossible for two different metal strips to be simultaneously on the same section of the exit roller track. The gap may also be necessary if a change is planned to the roll gap, due to a change in the thickness in the following metal strip. The increase in speed also means that the subsequent parts of the plant, for example the induction furnace, finishing line and the cooling line will be passed through more rapidly.

When the strip passes through the finishing line, temperature rises also occur due to the greater speed, which has a negative effect on the mechanical properties of the strip and on its surface quality. So that the mechanical properties of the metal strip remain homogeneous over its length, the process parameters of the plant sections must be adjusted appropriately, in order to avoid disadvantageous temperature rises. The cooling pattern of the cooling zone must also be appropriately adjusted. The cutting at the shears prior to the finishing line has a particularly disadvantageous effect in the case of an ESP (Endless Strip Production) plant, because the advantages of the stable endless operation are thereby obviated.

WO/59650 discloses a plant with a continuous casting facility, a pre-rolling line, a cutting facility, a furnace, a coiling facility, a descaler, a finish-rolling line, a cooling facility, shears and yet another coiling facility. An intermediate strip is cross-cut at a cutting facility, wherein a preceding metal strip has a strip tail and a following metal strip has a strip head.

The strip tail which has already been cross-cut and the strip head which is also already physically present are then superheated in an induction furnace and are wound up by means of the coiling facility. After this, the metal strip is unwound again from the coil and is finish-rolled on a finishing line. Due to the superheated strip head and strip tail of the metal strip, this plant is especially suitable for rolling thin metal sheets of >1 mm. The superheating of the strip head and strip tail result in comparable qualities as are the case with cold-rolled metal strips. Shears are arranged after a cooling facility. The shears can cross-cut the thin hot-rolled metal strip to strip lengths.

EP0730916 A1 discloses a hot-rolling line, which has the following plant sections, a continuous casting facility, a furnace, a rolling line, shears and a coiling facility. On the hot-rolling line, one can change the thickness of the metal strip to be rolled during ongoing operation. A tracking device enables the change in the thickness of the metal strip to be detected, and the shears are actuated by this tracking device. When a change in thickness of the metal strip is detected, the shears are activated to make a cross-cut. In the coiling facility which follows, the metal strip is then finally coiled up again.

SUMMARY OF THE INVENTION

It is the object of this invention to provide a method and a facility of the type mentioned in the introduction, with which even metal strips with a thickness greater than 4 mm and/or metal strips made of high-strength materials (yield stresses over 500 MPa) can be cross-cut using shears which are arranged after a finish-rolling line and after a cooling line.

This object is achieved for the method mentioned in the introduction by cooling the metal strip in the cooling zone to a prescribed temperature profile in the longitudinal direction of the metal strip, so that in the region of the strip head of the following section of metal strip and the strip tail of the preceding section of metal strip, the metal strip has a higher temperature than in the preceding and following regions.

To do this, the metal strip is fed in the direction of transport through a cooling zone. In the cooling zone, the metal strip is cooled down. After this, a cross-cut is made in the metal strip at the shears, so that the cross-cut metal strip has a strip head of the following section of metal strip and a strip tail of the preceding section of metal strip. The start of a metal strip, in the direction of transport, is referred to as the strip head. The strip tail of the preceding section of metal strip is the end of the preceding section of metal strip after cross-cutting. Thus, until the cross-cutting, the strip head of the following metal strip and the strip tail of the preceding metal strip are identical, and each only exists as an imaginary plane transverse to the direction of transport. The strip head of the following section of metal strip and the strip tail of the preceding section of metal strip are defined even before they enter into the cooling facility, and not merely after the cross cut has been made. The term 'section of metal strip' defines that part of the metal strip which is wound up into one coil. Hence, during production many individual sections of metal strip are created. Until the cross-cutting, the sections of metal strip are all part of a unitary metal strip. After the cross-cut has been made, and the advancing section of metal strip has been finally coiled up, what was previously the following section of metal strip becomes the leading section of metal strip for the next cross-cut. In the region of the strip head of the following section of metal strip and the strip tail of the preceding section of metal strip a temperature profile is set, by the cooling zone, which has a higher temperature than in the regions located before and after them.

By causing the higher temperature in the region of the strip head of the following section of metal strip and the strip tail of the preceding section of metal strip, the yield stress in the region is reduced, preferably by up to 50%. For the highest strength steel varieties, the reduction in the yield stress can even be >50%. The cutting force which must be applied for cross-cutting the strip is thereby reduced correspondingly. Cross-cutting of the metal strip can be effected without problem using commonly used shears. It is thus possible to forgo making the shears larger which is anyway also only possible within a limited range due to inertia, and which in addition has high associated costs. Furthermore, it is also unnecessary to cut the metal strip using the cutting facility (i.e. before the finish-rolling line) and to design the subsequent parts of the plant to be larger, or to arrange after the finishing line additional second shears designed for cross-cutting the large thicknesses. This method ensures that the same plant can also cross-cut high strength metal strips and/or metal strips with a thickness >4 mm without having to accept any loss of quality in the strip characteristics and the surface quality.

In one advantageous embodiment of the method, the region of the strip head of the following section of metal strip and the strip tail of the preceding section of metal strip is tracked constantly (i.e. in real time), at least from the start of the cooling zone up to the shears. The strip head of the following section of metal strip and the strip tail of the preceding section of metal strip are already defined before the metal strip passes into the cooling zone. By the tracking of the strip head of the following section of metal strip and the strip tail of the preceding section of metal strip, this region is constantly determined during its entire passage, from at least the start of the cooling zone up to the shears. This makes it possible to set selectively a temperature profile in the desired region of the later strip head and strip tail.

The temperature profile which is set on the metal strip is advantageously a ramp profile. This makes it possible to set an optimized temperature profile for each quality and/or thickness of steel in order to minimize the cutting force at the shears. However, it is also possible to make use of other temperature profiles, for example a step profile or a sine-shaped temperature profile.

Advantageously, the temperature in the region of the strip head of the following section of metal strip and the strip tail of the preceding section of metal strip is higher by at least 100° C. than that of the rest of the metal strip. Above this temperature difference, the forces which must be used for cross-cutting start to reduce significantly.

With one particularly preferred embodiment of the invention, the strip tail of the preceding section of metal strip and the strip head of the following section of metal strip are not cooled while the remaining regions of metal strip are cooled. This enables the forces to be applied in cross-cutting to be the most reduced.

The metal strips for which this method is particularly suitable are those consisting of high and maximum strength materials, especially pipe steels such as X70 or X80, hot strip multi-phase steels, for example dual phase steels DP600, DP800, DP1000, among others, or fully martensitic steels.

This method makes it possible to cross-cut even high-strength metal strips with a thickness >4 mm. For this purpose, the shears need not be larger in construction. Using the inventive method it is possible, with the same plant configuration, with shears of which standard use is made, to cross-cut without problem a metal strip made, for example, of DP1000 dual-phase steel with a thickness of 8 mm. Without the inventive method, only a maximum of 4 mm would be possible. It is of course also conceivable that use is made of smaller shears, with which, for example, a maximum thicknesses of 2.5 mm could be cross-cut. Using the inventive method it is possible, using the same shears, to cross-cut metal strips of 5 mm with no problem.

In order to produce the temperature profile on the metal strip, it is advantageous if this is effected by the amount of coolant fed in the cooling zone. The temperature profile is set in the cooling zone, in the region of the strip head of the following section of metal strip and the strip tail of the preceding section of metal strip, in that in this region the coolant is either not applied at all or only to a reduced extent.

During the passage of the strip head of the following section of metal strip and the strip tail of the preceding section of metal strip through the cooling zone, the feed of the coolant is adjusted according to the desired temperature profile.

In a further expedient embodiment, the adjustment of the amount of coolant is effected discretely. In the case of a discrete setting of the amount, either 100% of the coolant is applied, or 0%. This has the advantage that the design of the cooling zone can be simple, with no requirement for expensive adjustment elements—e.g. for setting the amount. A design of a continuous nature is equally conceivable. In this case the setting is effected by means of the amount or the pressure.

This method is particularly advantageously suitable if the metal strip is rolled on a rolling line of a combined continuous casting/rolling plant before cooling in the cooling zone. This method can also be applied even in existing plants without major conversion measures. The application of this method is especially preferred for ESP (Endless Strip Production) plants. This brings the clear advantages that, with the same plant configuration, endless operation can also be extended to high-strength qualities and greater thicknesses without having to accept any disadvantageous implications for the strip characteristics.

A further advantageous embodiment of the method is that the metal strip is coiled up on a coiler after cross-cutting. Due to the higher temperature of the strip head of the following section of metal strip, the threading up on the coiler is made easier as is the subsequent winding on. At the same time, instances of damage such as dents in the driving rollers are avoided. The term coiler refers to the facility which coils up the metal strip.

A further advantageous embodiment is that the length of a partial piece of a metal strip which has a raised temperature is ≥ a circumference of one coil, so that the coil is hot-packed by the strip tail of the preceding section of metal strip. The raised temperature of the strip tail of the preceding section of metal strip has in addition the positive effect that the metal strip cools down more uniformly. Because the outermost layer cools down more quickly—than those lying beneath it the cooling down process is more uniform over the entire length of the coiled-up metal strip, which results in more homogeneous properties. The length of the hot strip tail should advantageously be at least equal to the circumference of the coil. The term coil refers to the metal strip which is wound up on the coiler to form a roll.

For cross-cutting the metal strip, one particularly advantageous implementation is that the blade gap of the shears be set as a function of the thickness of the metal strip. This makes it possible to optimize yet further the operation of cross-cutting, even during operation, and the cutting forces can be further reduced depending on the thickness of the metal strip. There is, to a first approximation, a linear relationship between the ideal blade gap and the thickness of the metal strip.

The object of the invention is also achieved by the facility mentioned in the introduction, which comprises the following:

- a tracking facility for tracking the strip head of the following section of metal strip and the strip tail of the preceding section of metal strip, at least from the start of the cooling facility up to the shears, and
- a control facility for controlling the cooling facility and the shears as a function of the position of the strip head of the following section of metal strip and the strip tail of the preceding section of metal strip.

Using this facility, it is possible to track continuously the position of the later strip head and strip tail of the metal strip, at least from the start of the cooling facility up to the shears, and to control the cooling facility according to the position of the later strip head of the following section of metal strip and the strip tail of the preceding section of metal strip.

By contrast with this, the document EP0730916 shows a tracking facility which detects a change in the strip thickness. Shears are then actuated by this tracking facility. However, a tracking facility from the start of the cooling facility up to where the shears are reached is not shown in this document. Nor is any actuation of the cooling facility by reference to the position of the strip head and strip tail shown. An embodiment of this type also cannot be deduced without a knowledge of the method disclosed above, and it is also not in any way obvious.

One advantageous embodiment of the cooling facility has at least three cooling sections, separate from one another, wherein the at least three cooling sections can be controlled or regulated separately from each other. Having at least three separate cooling sections ensures that the temperature profile can be reliably produced on the metal strip. When the region of the strip head of the following section of metal strip and the strip tail of the preceding section of metal strip, which is to have a higher temperature, reaches the cooling line, the cooling section which is first in the direction of transport is switched off, while the other cooling sections remain switched on. When the region of the strip head of the following section of metal strip and the strip tail of the preceding section of metal strip, which is to have a higher temperature, approaches a second cooling section, this too is switched off and, as soon as the region of the strip head of the following section of metal strip and the strip tail of the preceding section of metal strip, which is to have a higher temperature, has left the first cooling section, this is switched on again. When the region of the strip head of the following section of metal strip and the strip tail of the preceding section of metal strip, which is to have a higher temperature, approaches a third cooling section, this is switched off and, as soon as the region of the strip head of the following section of metal strip and the strip tail of the preceding section of metal strip, which is to have a higher temperature—has left the second cooling section, this is switched on again. This takes place in an analogous way for all of the subsequent cooling sections of the cooling facility. Exactly when the particular cooling section is switched on or off depends on what temperature profile is to be produced on the metal strip, and how many cooling sections the cooling facility has. Above all, however, it is dependent on which region before the strip tail of the preceding section of metal strip and which region after the strip head of the following section of metal strip are to have a higher temperature.

In order to be able to ensure particularly exact tracking of the position of the strip head of the following section of metal strip and the strip tail of the preceding section of metal strip, it is advantageous if the tracking facility has a computing facility and at least one position or speed sensor, which control the cooling facility before the cross-cutting of the metal strip in such a way that the desired temperature profile is set in the region of the strip head of the following section of metal strip and of the strip tail of the preceding section of metal strip. The position or speed sensor can be a contact arrangement (e.g. pressing down of a roller or from the rotational speed at the coiler) or a non-contact arrangement (optically, for example using a laser).

With respect to the form of embodiment of the cooling facility, it is expedient to make the cooling facility as a water cooling line.

It is particularly advantageous if the cooling facility is constructed in such a way that in the direction of transport the amount of water flowing through the jets of the cooling facility can be controlled or regulated individually or in sections by a setting facility which is linked to the control facility. The water jets are mounted on spray bars. If one looks along the direction of transport at the individual spray bars, which extend across the direction of transport over the entire width of the metal strip, then each spray bar represents of itself the smallest section. On these spray bars there can be, e.g. little tubes or jets through which the water emerges. The sections can then, depending on the requirements which the metal strip concerned demands, be split up into any desired sizes. It is thus even possible to actuate several spray bars jointly. However, it is also conceivable that each jet on each spray bar is actuated individually.

In one advantageous embodiment, the tracking of the region of the strip head of the following section of metal strip and the strip tail of the preceding section of metal strip is implemented with a temperature measuring facility. In order to detect the strip tail of the preceding section of metal strip and the strip head of the following section of metal strip, use can again be made of temperature measurement facilities. The advantages which result from doing so are: to compare the temperature profile with the prescribed one, to determine the exact position of the strip head of the following section of metal strip and the strip tail of the preceding section of metal strip and to compare it with the calculated position. The temperature measurement facilities can be arranged in the most varied of positions. Here, advantageous positions are before the cooling zone, in the middle of the cooling zone, after the cooling zone and before the shears.

For cross-cutting the metal strip, one particularly advantageous embodiment is that the shears have a facility for adjusting the blade gap, wherein the then current thickness of the metal strip can be fed to the facility for adjusting the blade gap. By this means, the process of cross-cutting can be further optimized and the cutting forces further restricted, depending on the thickness of the metal strip.

Setting of the blade gap is effected according to the thickness of the metal strip. The thicker is the metal strip which to be cross-cut, the larger is the blade gap made.

Further advantages and features of the present invention are revealed from the description which follows of exemplary embodiments, not restrictive, wherein reference is made to the figures below, which show the following:

BRIEF DESCRIPTION OF THE DRAWINGS

FIGS. 4A and 4B together show a temperature profile in accordance with the invention for a metal strip.

FIG. 7A and FIG. 7B show the inventive temperature profile of a metal strip shortly before and shortly after cross-cutting.

FIG. 7C shows the temperature profile of the strip head of the following section of metal strip and strip tail of the preceding section of the metal strip.

DESCRIPTION OF AN EMBODIMENT

Figure 1:
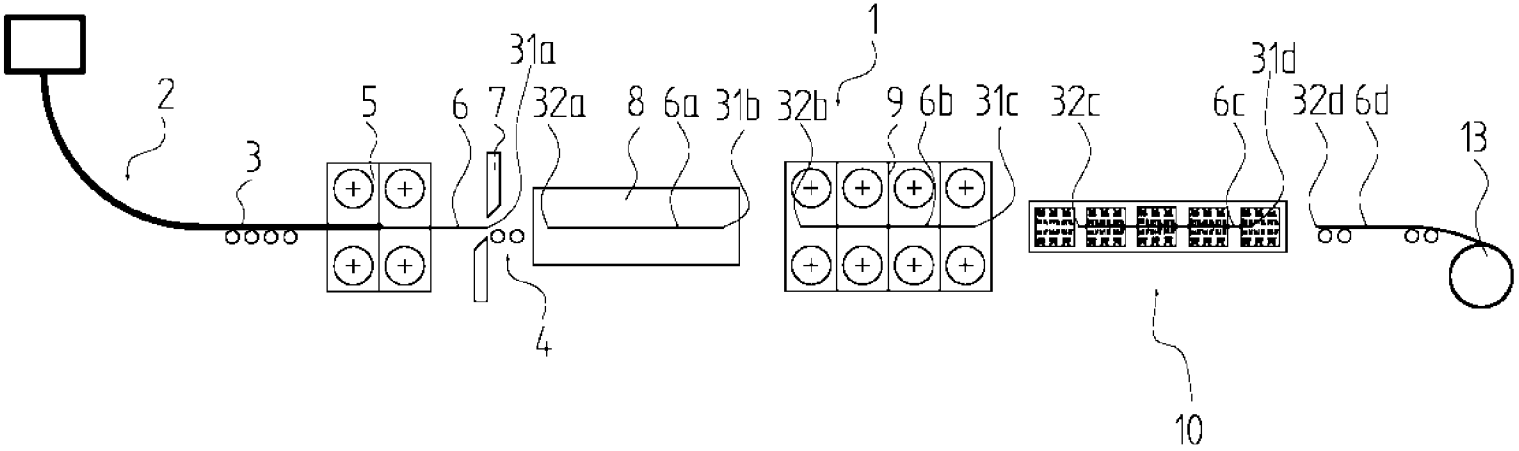
FIG. 1 (PRIOR ART)
FIG. 1 is a schematic representation of a combined casting-rolling plant in accordance with the prior art.

FIG. 1 shows a combined casting-rolling plant 1. In normal operation, a continuous-casting plant 2 produces a continually cast starting material 3 with a slab cross-section, which is transported by means of a roller track 4 to a pre-rolling line 5. After pre-rolling on the pre-rolling line 5, the metal strip 6 reaches the cutting facility 7. In accordance with the prior art, cross-cutting of the metal strip 6 would take place here using a cutting facility 7 which in this case is pendulum shears. After this, gaps are introduced between the metal strips 6*a*-6*d* by powered rollers of the roller track 4. The leading strip heads 31*a*-31*d* and the trailing strip tails 32*a*-32*d* are formed by the cross-cutting. After passage through the induction furnace 8, the finishing line 9 and the cooling zone 10, the metal strip is wound up on the coiler 13.

Figure 2:
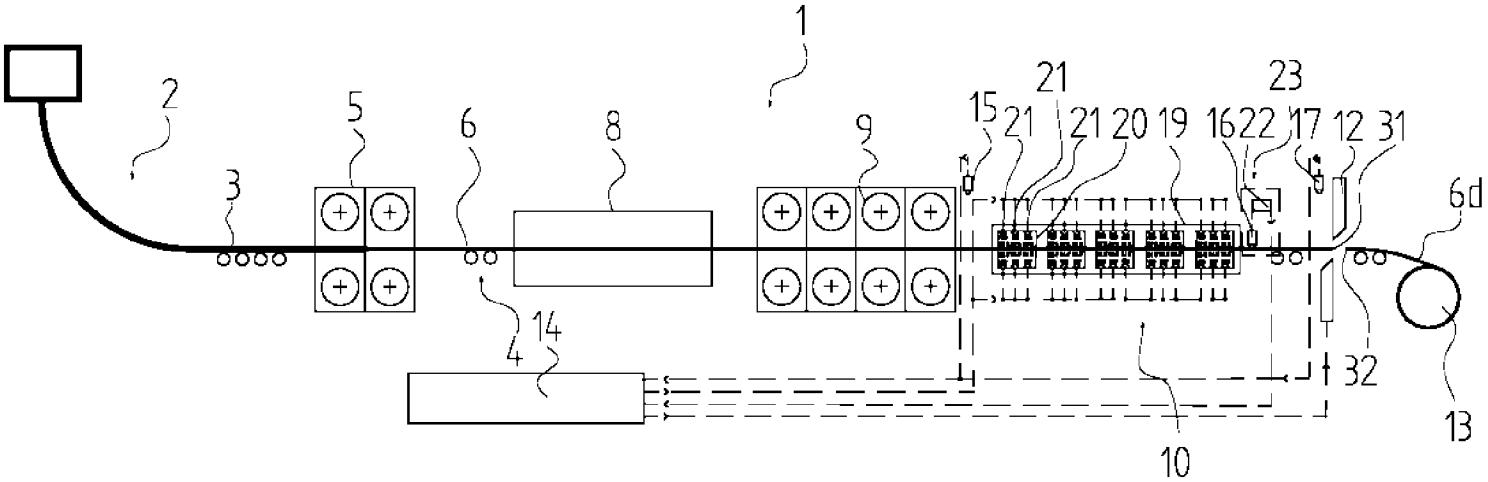
FIG. 2 is a schematic representation of a combined casting-rolling plant for cross-cutting metal strips in accordance with the invention.

FIG. 2 shows a form of embodiment in accordance with the invention of the facility for cross-cutting metal strips. The first steps as far as the pre-rolling line 5 are carried out analogously with the prior art as in FIG. 1. This is not followed by cross-cutting, but the metal strip 6 passes uncut through the induction furnace 8, the finishing line 9 and after this reaches the cooling zone 10. Before the metal strip 6 enters into the cooling zone 10, the actual temperature of the metal strip 6 is detected by a first temperature sensor 15, and is transmitted to the control facility 14. In the cooling zone 10, the desired temperature profile is produced on the metal strip 6 by appropriate actuation by the control facility 14 of the water spray bar sections 20 or even only individual spray bars 21—of the cooling facility 19. The strip head 31 of the following section of metal strip and the strip tail 32 of the preceding section of metal strip of the metal strip 6 (see bottom of FIGS. 4A and 4B) are determined by the control facility 14 with the aid of the position sensor 16 and the computing facility 22, and their position is continuously determined. The position sensor 16 can be implemented either in a contact format (e.g. by pressing onto a roller, or from the rotational speed at the coiler) or in a non-contact format (optically, e.g. using a laser). The position sensor 16 and the computing facility 22 form the tracking facility 23. The spray bars 21 can be adjusted over the entire passage of the strip head 31 of the following section of metal strip and the strip tail 32 of the preceding section of metal strip according to the prescribed temperature profile. After its passage through the cooling facility 19, the metal strip 6 has—in the region of the strip head 31 of the following section of metal strip and the strip tail 32 of the preceding section of metal strip—a higher temperature than in the regions before and after them. After the strip head 31 of the following section of metal strip and the strip tail 32 of the preceding section of metal strip have passed completely through the cooling zone 10, the temperature profile is once again detected by a second temperature sensor 17 and is communicated to the control facility 14 in order to compare the actual profile with the intended profile. When the strip head 31 of the following section of metal strip and the strip tail 32 of the preceding section of metal strip have reached the shears 12, the latter receives a signal from the control facility 14, and the metal strip 6 is cross-cut. The preceding metal strip 28 is finish-wound on the coiler 13, following which the strip head 31 of the following section of metal strip is threaded onto the coiler 13 and the coiling procedure is started.

Figure 3A:
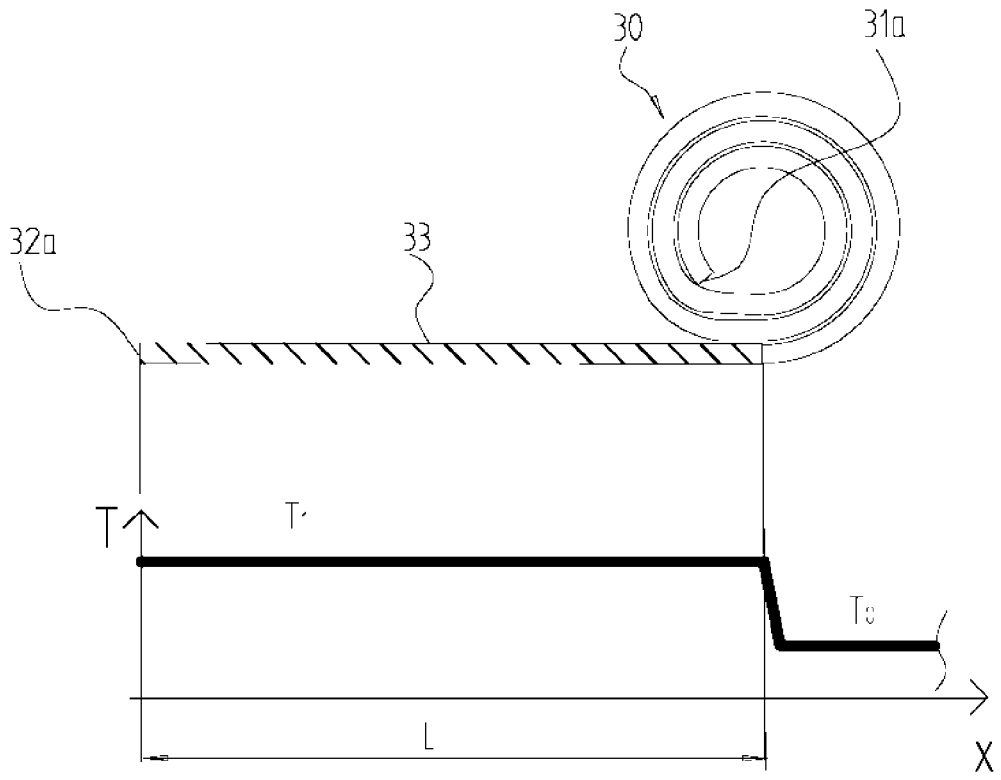
FIG. 3A and FIG. 3B show the hot packing of a coil.
Figure 3B:
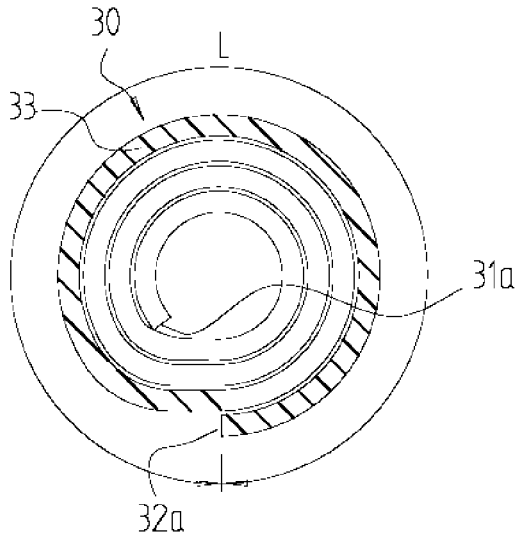

FIG. 3A and FIG. 3B show how the coil 30 is hot-packed. FIG. 3A shows the wound-up coil 30, on the inside the strip head 31*a*, a partial piece of metal strip with a temperature $T_0$, a partial piece of metal strip 33 with a length of L with a temperature $T_1$ together with the strip tail 32*a*. The length L of the partial piece of metal strip is here the length of the circumference of the coil 30. The temperature of the partial piece of metal strip 33 is here a higher temperature $T_1$ than the temperature $T_0$ of the preceding part of the metal strip. The diagram shows the temperature T along the length x of the metal strip which is here the extended length.

FIG. 3B shows that the hot partial piece of metal strip 33 encloses the coil 30.

FIGS. 4A and 4B show a typical temperature profile in accordance with the invention along the temperature-profiled length xp of a metal strip 6. The temperature T1 in the region of the strip tail 32 of the preceding metal strip—along the strip tail length xf—is higher than after it, where a temperature T0 is set, until finally the region of the strip head 31 of the following section of metal strip follows, where a temperature T1 is again set—along the strip head length xk. The strip head length xk and the strip tail length xf need not be, as shown here, the same. They can also have different lengths. The strip head 31*a* of the preceding metal strip 28 also has a temperature profile with the temperature T1. After cross-cutting on the shears, the metal strip 6 is divided into a preceding section of metal strip 28 and a following section of metal strip 29. However, even before the cross-cutting—at least as soon as the two sections reach the cooling facility—it is defined as a preceding section of metal strip 28 and a following section of metal strip 29.

Figure 5A:
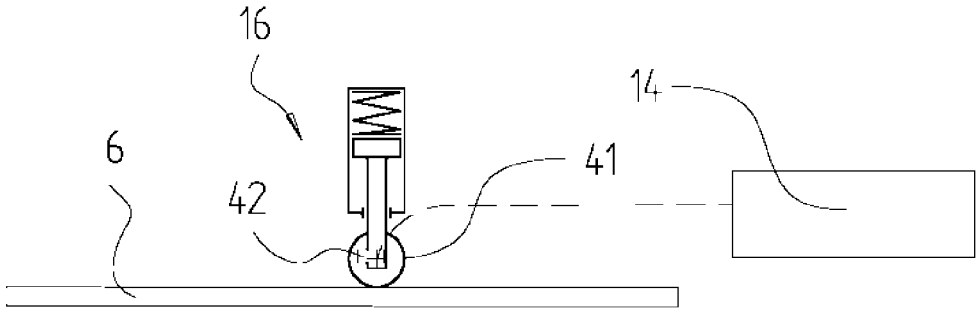
FIG. 5A and FIG. 5B show variant embodiments of a position sensor and a speed sensor.

FIG. 5A shows in more detail an embodiment of a position sensor 16, which includes a roller 41, which is pressed down onto the metal strip 6. The movement of the metal strip 6 rotates the roller 41 which is pressed down on the strip, and this is detected by an optical sensor 42. The signal thereby generated is processed further in the control facility 14. From this signal and various further information, such as, for example, the desired length of the metal strip, the control facility 14 calculates the position of what will later be the strip head and strip tail, at least in the region from the start of the cooling zone 10 up to the shears 12. The spray bar sections 20 or, if applicable, the individual spray bars 21 in the cooling zone are actuated to establish a desired temperature profile on the metal strip 6.

Figure 5B:
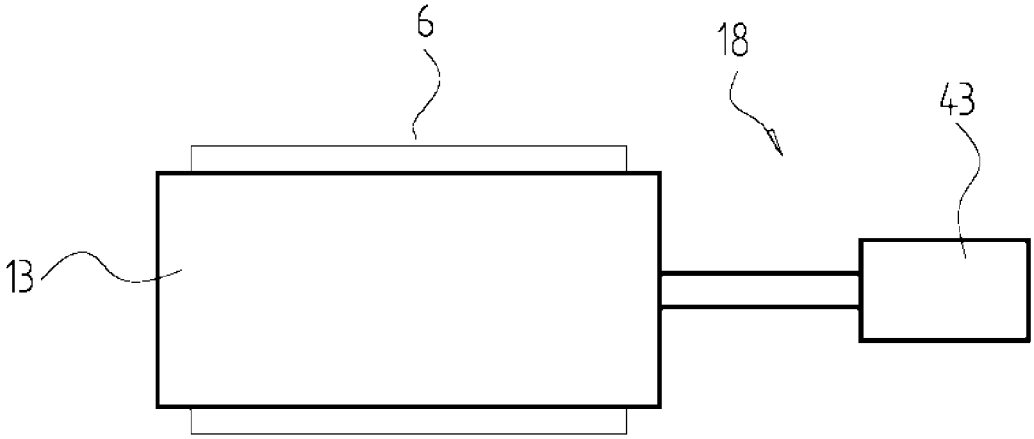

FIG. 5B shows a variant embodiment of a speed sensor 18. It detects the position of the metal strip 6 from the rotational speed of the coiler 13 by an angular rotation encoder 43. Based on knowledge of the thickness of the metal strip 6, the diameter of the coiler 13 and further information which is critical for its manufacture, for example the desired length of the metal strip, the positions of the strip head 31 and strip tail 32 in the cooling zone 10 are determined.

Figure 6:
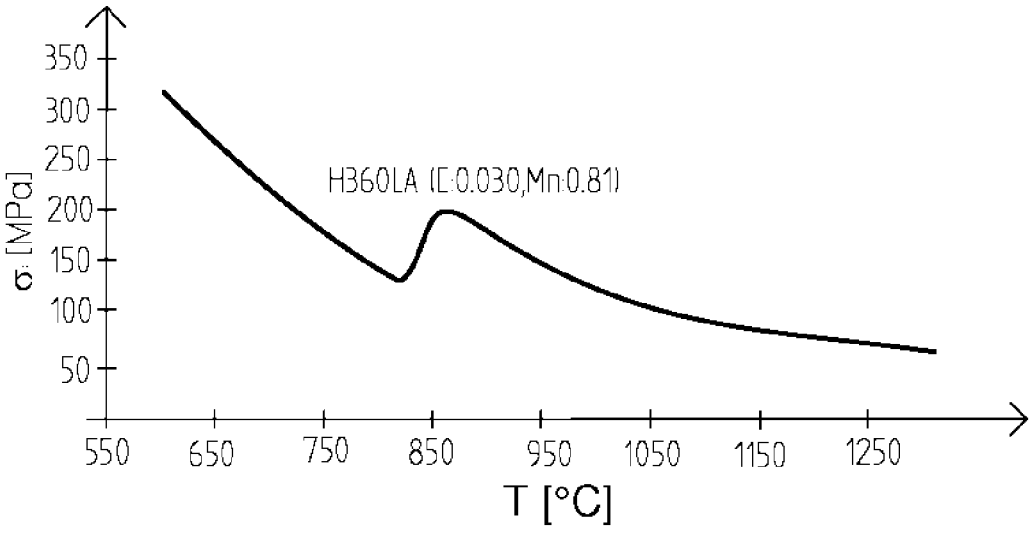
FIG. 6 shows a diagram of yield stress against temperature, from M. Spittel and T. Spittel Landolt-Bornstein Group VIII: Advanced Materials and Technologies, Volume 2, Springer Verlag, 2007, p. 11.

FIG. 6 shows the relationship of the yield stress $\sigma_F$ against the temperature T for an H360LA steel. The yield stress of 300 MPa at about 600° C. falls to 150 MPa at about 800° C. Thus, by raising the temperature of the metal strip by about 200° C., it is possible to greatly reduce the cutting forces at a set of shears.

FIG. 7A shows the metal strip 6 immediately before cross-cutting. The strip tail 32 of the preceding section of metal strip and the strip head 31 of the following section of metal strip are still identical prior to the cross-cutting, and are only there as an imaginary plane. The preceding section of metal strip already has a strip head 31*a*, caused by the previous cross-cutting FIG. 7B, shows the stripe after the cross-cutting. In the transport direction 34 there is a preceding section of metal strip 28 with the strip tail 32 of the preceding section of metal strip and a following section of metal strip 29 with a strip head 31 of the following section of metal strip. After cross-cutting, the preceding section of metal strip has a strip head 31*a* and the strip tail 32 of the preceding section of metal strip. The region of the strip head 31 of the following section of metal strip and the region of the strip tail 32 of the preceding section of metal strip have the temperature profile shown in FIG. 7C.

LIST OF REFERENCE MARKS

1 Combined casting/rolling plant
2 Continuous casting plant
3 Preliminary material
4 Roller track
5 Pre-rolling line
6, 6*a*-6*d* Metal strip
7 Cutting facility
8 Induction furnace
9 Finishing line
10 Cooling zone
12 Shears
13 Coiler
14 Control facility
15 First temperature sensor
16 Position sensor
18 Speed sensor
17 Second temperature sensor
19 Cooling facility
20 Spray bar sections
21 Spray bars
22 Computing facility
23 Tracking facility
28 Preceding section of metal strip
29 Following section of metal strip
30 Coil
31 Strip head of the following section of metal strip
31*a*-31*d* Strip head
32 Strip tail of the preceding section of metal strip
32*a*-32*d* Strip tail
33 Partial piece of metal strip
34 Direction of transport
41 Roller
42 Optical sensor
43 Angular rotation encoder
L Length of the partial piece of metal strip
T Temperature
xp Length of temperature profile
xf Length of strip tail
xk Length of strip head
x Length of metal strip
$\sigma_f$ Yield stress

The invention claimed is:

1. A method for cross-cutting a metal strip, the metal strip having a preceding section with a strip tail and a following section with a strip head, the method comprising:

feeding the metal strip in a direction of transport through a finishing line and thereafter a controllable cooling zone so that, in the direction of transport, the strip head of the following section of the metal strip follows on immediately after the strip tail of the preceding section of metal strip, the metal strip being more than 4 mm thick;

cooling the metal strip preceding section and following section to a cooling temperature according to a temperature profile while the metal strip is transported through the controllable cooling zone to define a cross-cut region having a higher temperature and lower yield strength located between the cooled preceding section and the cooled following section of the metal strip; and cross-cutting the metal strip along the higher temperature cross-cut region with shears that are not capable of cutting the strip at the cooling temperature of the following section and the preceding section to define the strip tail of the preceding section and the strip head of the following section.

2. The method as claimed in claim 1, further comprising tracking the strip head of the following section and the strip tail of the preceding section, at least from the start of the controllable cooling zone up to the shears.

3. The method as claimed in claim 1, wherein the temperature profile is selected to have a ramp profile.

4. The method as claimed in claim 1, wherein the higher temperature cross-cut region is at least 100° C. above the cooling temperature of the preceding and following sections.

5. The method as claimed in claim 4, further comprising not applying the cooling to the strip head of the following section and the strip tail of the preceding section to obtain the higher temperature cross-cut region.

6. The method as claimed in claim 1, wherein the metal strip has a yield stress of 500 MPa or more.

7. The method as claimed in claim 6, wherein the metal strip is comprised of pipe steel, hot strip multi-phase steel or fully martensitic steel.

8. The method as claimed in claim 1, further comprising setting the temperature profile by applying a determined quantity of coolant fed onto the metal strip.

9. The method as claimed in claim 8, further comprising adjusting discretely the quantity of coolant fed.

10. The method as claimed in claim 1, further comprising, before cooling the metal strip in the controllable cooling zone, rolling the metal strip on a rolling line of a combined casting/rolling facility.

11. The method as claimed in claim 1, further comprising, after cross-cutting the metal strip, winding the metal strip on a coiler to obtain a coil.

12. The method as claimed in claim 11, wherein the metal strip is wound to have a coil section and a partial piece with a length that is the same as the circumference of the coil section, and a temperature higher than the coil section.

13. The method as claimed in claim 1, further comprising setting a blade gap of the shears as a function of the thickness of the metal strip.

14. A facility for cross-cutting a metal strip that is thicker than 4 mm, comprising:

a roller track configured for feeding the metal strip that is thicker than 4 mm in a direction of transport;

a finishing line;

shears located after the finishing line and configured and operable for cross-cutting the metal strip at intervals as the metal strip passes the shears, so that the metal strip is cross-cut into a preceding section of metal strip having a strip tail and a following section of metal strip having a strip head, the strip head of the following section being immediately behind the strip tail of the preceding section in the direction of transport, the shears being unable to cross-cut a strip that is more than 4 mm thick when the metal strip is below a threshold temperature and has a yield strength at the threshold temperature that would not permit cross-cutting by the shears, and the shears being operable to cross-cut the metal strip along a cross-cut region located between the strip head of the following section and the strip tail of the preceding section;

at least one controllable cooling facility located after the finishing line and arranged in the direction of transport before the shears;

a tracking facility configured and operable for tracking the position of the strip head of the following section and the strip tail of the preceding section, at least from the start of the cooling facility up to the shears; and a control facility configured and operable to control the controllable cooling facility and the shears as a function of the position of the strip head of the following section and the strip tail of the preceding section to cool the metal strip such that the cross-cut region is hotter than the threshold temperature to have a lower yield strength than the rest of the metal strip when passing by the shears while the rest of the metal strip is at a temperature below the threshold temperature, and for operating the shears for cross-cutting the strip along the cross-cut region.

15. The facility as claimed in claim 14, wherein the cooling facility has at least three cooling sections which are separate from each other at spaced intervals along the metal strip, and wherein the at least three cooling sections are controlled or regulated separately from each other by the control facility.

16. The facility as claimed in claim 14, wherein the tracking facility has a computing facility configured and operable for determining when the cooling facility is to be operated and has a position sensor or a speed sensor for the metal strip for enabling the computing facility to operate the cooling facility.

17. The facility as claimed in claim 14, wherein the cooling facility comprises a water cooling line configured for supplying water to the metal strip.

18. The facility as claimed in claim 17, further comprising water jets for flowing of water from the cooling line; wherein the control facility controls the amount of flow through the water jets in the direction of transport of the metal strip individually or in sections.

19. The facility as claimed in claim 14, further comprising a setting facility which is linked to the control facility, wherein the tracking facility is a temperature measurement facility.

20. The facility as claimed in claim 14, wherein the shears have shearing blades with a blade gap, and further comprising a facility for adjusting the blade gap between the blades of the shears, wherein a current thickness of the metal strip is fed to the facility to adjust the blade gap.

21. The method as claimed in claim 2, wherein the strip head of the following section and the strip tail of the preceding section are tracked constantly.

* * * * *